US011763760B1

(12) United States Patent
Guo et al.

(10) Patent No.: US 11,763,760 B1
(45) Date of Patent: Sep. 19, 2023

(54) BACKLIGHT MODULE AND DISPLAY DEVICE

(71) Applicant: TCL CHINA STAR OPTOELECTRONICS TECHNOLOGY CO., LTD., Guangdong (CN)

(72) Inventors: Xiaoying Guo, Guangdong (CN); Junyao Fan, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 17/772,645

(22) PCT Filed: Apr. 13, 2022

(86) PCT No.: PCT/CN2022/086501

§ 371 (c)(1),
(2) Date: Apr. 28, 2022

(30) Foreign Application Priority Data

Apr. 2, 2022 (CN) ..... 202210350992.5

(51) Int. Cl.
*G09G 3/34* (2006.01)
*G09G 3/32* (2016.01)

(52) U.S. Cl.
CPC ..... *G09G 3/342* (2013.01); *G09G 3/32* (2013.01); *G09G 3/3406* (2013.01); *G09G 2330/021* (2013.01)

(58) Field of Classification Search
None
See application file for complete search history.

(56) References Cited

U.S. PATENT DOCUMENTS

2007/0115662 A1* 5/2007 Roberts ..... G09G 3/3413 362/249.16
2009/0102782 A1* 4/2009 Lin ..... H05B 45/46 345/102

(Continued)

FOREIGN PATENT DOCUMENTS

CN 1909347 A 2/2007
CN 102325401 A 1/2012

(Continued)

OTHER PUBLICATIONS

International Search Report in International application No. PCT/CN2022/086501, dated Nov. 30, 2022.

(Continued)

*Primary Examiner* — Dorothy Harris
(74) *Attorney, Agent, or Firm* — Mark M. Friedman

(57) ABSTRACT

The present application discloses a backlight module and a display device. The backlight module includes a plurality of light-emitting units, a plurality of drive chips, a plurality of cascaded voltage comparators, and a voltage adjustment module. The light-emitting unit connected to a control terminal of a same drive chip is connected with a same initial drive voltage. The plurality of cascaded voltage comparators output an adjustment voltage in a N-th stage based on a preset voltage and a plurality of to-be-detected voltages. The voltage adjustment module is configured to adjust the initial drive voltage based on the adjustment voltage in the N-th stage.

20 Claims, 5 Drawing Sheets

(56) References Cited

U.S. PATENT DOCUMENTS

| | | | | |
|---|---|---|---|---|
| 2010/0201279 | A1* | 8/2010 | Zhao | H05B 45/20 315/185 R |
| 2014/0192102 | A1 | 7/2014 | Im et al. | |
| 2016/0155417 | A1* | 6/2016 | Chen | H05B 45/46 315/122 |
| 2017/0018230 | A1 | 1/2017 | Im | |

FOREIGN PATENT DOCUMENTS

| | | | | |
|---|---|---|---|---|
| CN | 202188381 | U | | 4/2012 |
| CN | 102968965 | A | | 3/2013 |
| CN | 103021346 | A | | 4/2013 |
| CN | 106211494 | A | | 12/2016 |
| CN | 110392463 | A | | 10/2019 |
| CN | 110996457 | A | | 4/2020 |
| CN | 211181607 | U | | 8/2020 |
| CN | 112233610 | A | | 1/2021 |
| CN | 112233625 | A | | 1/2021 |
| CN | 112419961 | A | | 2/2021 |
| CN | 114141203 | A | | 3/2022 |
| CN | 114495807 | A | * | 5/2022 |
| CN | 114708839 | A | * | 7/2022 |
| KR | 20150061919 | A | | 6/2015 |

OTHER PUBLICATIONS

Written Opinion of the international Search Authority in International application No. PCT/CN2022/086501, dated Nov. 30, 2022.
Chinese Office Action issued in corresponding Chinese Patent Application No. 202210350992.5 dated Mar. 25, 2023, pp. 1-7.

* cited by examiner

BACKLIGHT MODULE AND DISPLAY DEVICE

TECHNICAL FIELD

The present application relates to a technical field of display, and in particular, to a backlight module and a display device.

BACKGROUND

With development of display technology and panel industry, MLED (Micro/Mini Light-Emitting Diode) backlight technology appears to the public. Compared with conventional LED (Light-Emitting Diode) backlight, the MLED backlight has a local dimming function which realizes a high contrast and a high brightness, and thus display effect of the MLED backlight can reach that of an OLED (Organic Light-Emitting Diode). However, the MLED is more cost-effective than the OLED. Therefore, the MLED backlight has great development potential.

TECHNICAL PROBLEMS

However, in a MLED backlight, positive electrodes of a plurality of LEDs are connected together. When the LEDs are required to a certain brightness, a voltage required for each LED is different due to a manufacturing error of the LEDs. In order to ensure that all the LEDs give a same brightness, an initial drive voltage output by a power board tends to be high, which causes a voltage of a control terminal of a drive chip (LED Driver IC) connected to negative electrodes of the plurality of LED to be too high, thereby causing a power consumption and a temperature of the drive chip to rise.

SUMMARY

The present application provides a backlight module and a display device to solve the technical problems in the prior art where a control terminal voltage of a drive chip is too high to cause a power consumption and a temperature of the drive chip to rise.

The present application provides a backlight module, wherein the backlight module comprises:

a plurality of light-emitting units, wherein each of the plurality of light-emitting units has a positive electrode and a negative electrode, and at least a part of the positive electrodes of the plurality of light-emitting units are connected with a same initial drive voltage;

a plurality of drive chips, wherein each of the plurality of drive chips has a control terminal connected to the negative electrode of a corresponding light-emitting unit, and the light-emitting units connected to the control terminal of a same drive chip are connected with the same initial drive voltage;

a plurality of cascaded voltage comparators, wherein each of the plurality of drive chips corresponds to at least one of the voltage comparators, each of the plurality of voltage comparators has a first input terminal, a second input terminal and an output terminal; wherein a second input terminal of a voltage comparator in a N-th stage is connected with a to-be-detected voltage in the N-th stage, the to-be-detected voltage in the N-th stage is a voltage of the control terminal of the drive chip corresponding to the voltage comparator in the N-th stage, and an output terminal of the voltage comparator in the N-th stage outputs an adjustment voltage in the N-th stage; wherein a first input terminal of a voltage comparator in a first stage is connected with a preset voltage, and an adjustment voltage in the first stage is a lower one of the preset voltage and a to-be-detected voltage in the first stage; wherein a first input terminal of the voltage comparator in the N-th stage is connected with an adjustment voltage in a (N−1)-th stage, the adjustment voltage in the N-th stage is a lower one of the to-be-detected voltage in the N-th stage and the adjustment voltage in the (N−1)-th stage, and N is an integer greater than 1; and a voltage adjustment module, wherein the voltage adjustment module is connected with the adjustment voltage in the N-th stage, and the voltage adjustment module is configured to adjust the initial drive voltage based on the adjustment voltage in the N-th stage.

Optionally, in some embodiments of the present application, the voltage comparator is disposed in an one-to-one correspondence with the drive chip, the drive chip comprises a plurality of control terminals, each of the plurality of control terminals is connected to a negative electrode of a corresponding light-emitting unit, and the to-be-detected voltage in the N-th stage is a lowest one among the plurality of control terminals of the drive chip corresponding to the voltage comparator in the N-th stage.

Optionally, in some embodiments of the present application, the voltage comparator comprises a comparator and an inverter;

in a same voltage comparator, a first pole of the comparator is connected to the first input terminal, and a second pole of the comparator is connected to the second input terminal; the inverter comprises a first transistor and a second transistor, a gate of the first transistor and a gate of the second transistor are both connected to an output pole of the comparator, a source of the first transistor is connected to the second input terminal, a source of the second transistor is connected to the first input terminal, and a drain of the first transistor and a drain of the second transistor are both connected to the output terminal;

when the first pole of the comparator is a positive input terminal, and the second pole of the comparator is a negative input terminal, the first transistor is an N-type transistor, and the second transistor is a P-type transistor;

when the first pole of the comparator is a negative input terminal, and the second pole of the comparator is a positive input terminal, the first transistor is a P-type transistor, and the second transistor is an N-type transistor.

Optionally, in some embodiments of the present application, the initial drive voltage is lower than or equal to a voltage difference between the positive electrode and the negative electrode when the light-emitting unit emits a light normally;

when the adjustment voltage in the N-th stage is lower than the preset voltage, the voltage adjustment module is configured to increase the initial drive voltage.

Optionally, in some embodiments of the present application, the voltage adjustment module comprises a control unit and a power board;

the control unit is connected to an output terminal of the voltage comparator in the N-th stage to output a feedback voltage to the power board based on the adjustment voltage in the N-th stage; the power board is configured to adjust the initial drive voltage under a control of the feedback voltage.

Optionally, in some embodiments of the present application, the control unit comprises a microcontroller unit and a timing controller;

the microcontroller unit is connected to an output terminal of the voltage comparator in the N-th stage and configured to process the adjustment voltage in the N-th stage; the timing controller is connected to the microcontroller unit and comprises a power management integrated chip, the timing controller outputs a voltage compensation instruction to the power management integrated chip based on a processed adjustment voltage in the N-th stage, and the power management integrated chip outputs the feedback voltage based on the voltage compensation instruction.

Optionally, in some embodiments of the present application, the power board comprises at least one voltage adjustment circuit, and each of voltage adjustment circuits comprises a control chip, an inductor, a first resistor, and a second resistor;

the control chip has an input pin, a switch pin and a feedback pin; the input pin is connected with an initial voltage, an end of the inductor is connected to the switch pin, another end of the inductor and an end of the first resistor are connected to an output terminal of the initial drive voltage, another end of the first resistor and an end of the second resistor are connected to a feedback node, the feedback node is electrically connected to the feedback pin and is connected with the feedback voltage, and another end of the second resistor is grounded.

Optionally, in some embodiments of the present application, the light-emitting unit comprises one or more light-emitting diodes.

Optionally, in some embodiments of the present application, the voltage comparator is integrated in a corresponding drive chip.

Optionally, in some embodiments of the present application, the drive chip comprises a data transmission pin, adjacent drive chips are connected via the data transmission pin, and the drive chip provided with the voltage comparator in the N-th stage is connected to the voltage adjustment module via the data transmission pin;

wherein the drive chip is configured to output or receive a corresponding adjustment voltage via the data transmission pin based on a signal transmission protocol.

Optionally, in some embodiments of the present application, the drive chip comprises an adjustment voltage transmission pin, and the drive chips are connected to each other via the adjustment voltage transmission pin; the drive chip provided with the voltage comparator in the N-th stage further comprises a feedback pin, and is connected to the voltage adjustment module via the feedback pin.

Accordingly, the present application further provides a display device including a display panel and a backlight module, wherein the backlight module includes:

a plurality of light-emitting units, wherein each of the plurality of light-emitting units has a positive electrode and a negative electrode, and at least a part of the positive electrodes of the plurality of light-emitting units are connected with a same initial drive voltage;

a plurality of drive chips, wherein each of the plurality of drive chips has a control terminal connected to the negative electrode of a corresponding light-emitting unit, and the light-emitting units connected to the control terminal of a same drive chip are connected with the same initial drive voltage;

a plurality of cascaded voltage comparators, wherein each of the plurality of drive chips corresponds to at least one of the voltage comparators, each of the plurality of voltage comparators has a first input terminal, a second input terminal and an output terminal; wherein a second input terminal of a voltage comparator in a N-th stage is connected with a to-be-detected voltage in the N-th stage, the to-be-detected voltage in the N-th stage is a voltage of the control terminal of the drive chip corresponding to the voltage comparator in the N-th stage, and an output terminal of the voltage comparator in the N-th stage outputs an adjustment voltage in the N-th stage; wherein a first input terminal of a voltage comparator in a first stage is connected with a preset voltage, and an adjustment voltage in the first stage is a lower one of the preset voltage and a to-be-detected voltage in the first stage; wherein a first input terminal of the voltage comparator in the N-th stage is connected with an adjustment voltage in a (N−1)-th stage, the adjustment voltage in the N-th stage is a lower one of the to-be-detected voltage in the N-th stage and the adjustment voltage in the (N−1)-th stage, and N is an integer greater than 1; and a voltage adjustment module, wherein the voltage adjustment module is connected with the adjustment voltage in the N-th stage, and the voltage adjustment module is configured to adjust the initial drive voltage based on the adjustment voltage in the N-th stage.

Optionally, in some embodiments of the present application, the voltage comparator is disposed in an one-to-one correspondence with the drive chip, the drive chip comprises a plurality of control terminals, each of the plurality of control terminals is connected to a negative electrode of a corresponding light-emitting unit, and the to-be-detected voltage in the N-th stage is a lowest one among the plurality of control terminals of the drive chip corresponding to the voltage comparator in the N-th stage.

Optionally, in some embodiments of the present application, the initial drive voltage is lower than or equal to a voltage difference between the positive electrode and the negative electrode when the light-emitting unit emits a light normally;

when the adjustment voltage in the N-th stage is lower than the preset voltage, the voltage adjustment module is configured to increase the initial drive voltage.

Optionally, in some embodiments of the present application, the voltage adjustment module comprises a control unit and a power board;

the control unit is connected to an output terminal of the voltage comparator in the N-th stage to output a feedback voltage to the power board based on the adjustment voltage in the N-th stage; the power board is configured to adjust the initial drive voltage under a control of the feedback voltage.

Optionally, in some embodiments of the present application, the power board comprises at least one voltage adjustment circuit, and each of voltage adjustment circuits comprises a control chip, an inductor, a first resistor, and a second resistor;

the control chip has an input pin, a switch pin and a feedback pin; the input pin is connected with an initial voltage, an end of the inductor is connected to the switch pin, another end of the inductor and an end of the first resistor are connected to an output terminal of the initial drive voltage, another end of the first resistor and an end of the second resistor are connected to a feedback node, the feedback node is electrically connected to the feedback pin and is connected with the feedback voltage, and another end of the second resistor is grounded.

Optionally, in some embodiments of the present application, the light-emitting unit comprises one or more light-emitting diodes.

Optionally, in some embodiments of the present application, the voltage comparator is integrated in a corresponding drive chip.

Optionally, in some embodiments of the present application, the drive chip comprises a data transmission pin, adjacent drive chips are connected via the data transmission pin, and the drive chip provided with the voltage comparator in the N-th stage is connected to the voltage adjustment module via the data transmission pin;

wherein the drive chip is configured to output or receive a corresponding adjustment voltage via the data transmission pin based on a signal transmission protocol.

Optionally, in some embodiments of the present application, the drive chip comprises an adjustment voltage transmission pin, and the drive chips are connected to each other via the adjustment voltage transmission pin; the drive chip provided with the voltage comparator in the N-th stage further comprises a feedback pin, and is connected to the voltage adjustment module via the feedback pin.

BENEFICIAL EFFECTS

The present application discloses a backlight module and a display device. The backlight module include includes a plurality of light-emitting units, a plurality of drive chips, a plurality of cascaded voltage comparators, and a voltage adjustment module. Control terminals of the plurality of drive chips are connected to responding negative electrodes of the plurality of light-emitting units. A first input terminal of the voltage comparator in the first stage is connected with a preset voltage, a second input terminal of the voltage comparator in the N-th stage is connected with a to-be-detected voltage in the N-th stage, and N is an integer greater than or equal to 1. Since the to-be-detected voltage in the N-th stage is a voltage of a control terminal of the drive chip corresponding to the voltage comparator in the N-th stage, a plurality of cascaded voltage comparators can detect a voltage of at least one control terminal of each drive chip. That is, the plurality of cascaded voltage comparators can output the adjustment voltage in the N-th stage based on the preset voltage and the plurality of to-be-detected voltages, and then the voltage adjustment module is configured to adjust the initial drive voltage based on the adjustment voltage in the N-th stage. This prevents the voltage at the control end of the drive chip from being too high, thereby reducing the power consumption of the drive chip and a risk of overheating of the drive chip.

BRIEF DESCRIPTION OF THE DRAWINGS

In order to describe the technical solutions in the embodiments of the present application more clearly, the accompanying drawings required in the description of the embodiments will be briefly described below. It is obvious that the accompanying drawings in the following description merely refer to some embodiments of the present application, and other drawings may be obtained by those skilled in the art without creative efforts.

DETAILED DESCRIPTION OF THE EMBODIMENTS

The technical solutions in the embodiments of this application will be clearly and completely described below in conjunction with the accompanying drawings in the embodiments of the present application. It is clear that the described embodiments are only some but not all of the embodiments of this application. Based on the embodiments of the present application, all other embodiments obtained by a person skilled in the art without creative efforts are within the scope of the present application.

In the description of the present application, it is to be understood that the terms "first" and "second" are merely used for description purposes, and cannot be interpreted as indicating or implying relative importance or implicitly indicating the number of the technical features. Therefore, the features defined by "first" and "second" may explicitly or implicitly include one or more of said features, and therefore cannot be construed as limiting this application.

The present application provides a backlight module and a display device, which are described in detail below. It should be understood that the order of description of the following embodiments is not intended to limit the preferred order of the embodiments of this application.

Figure 1:
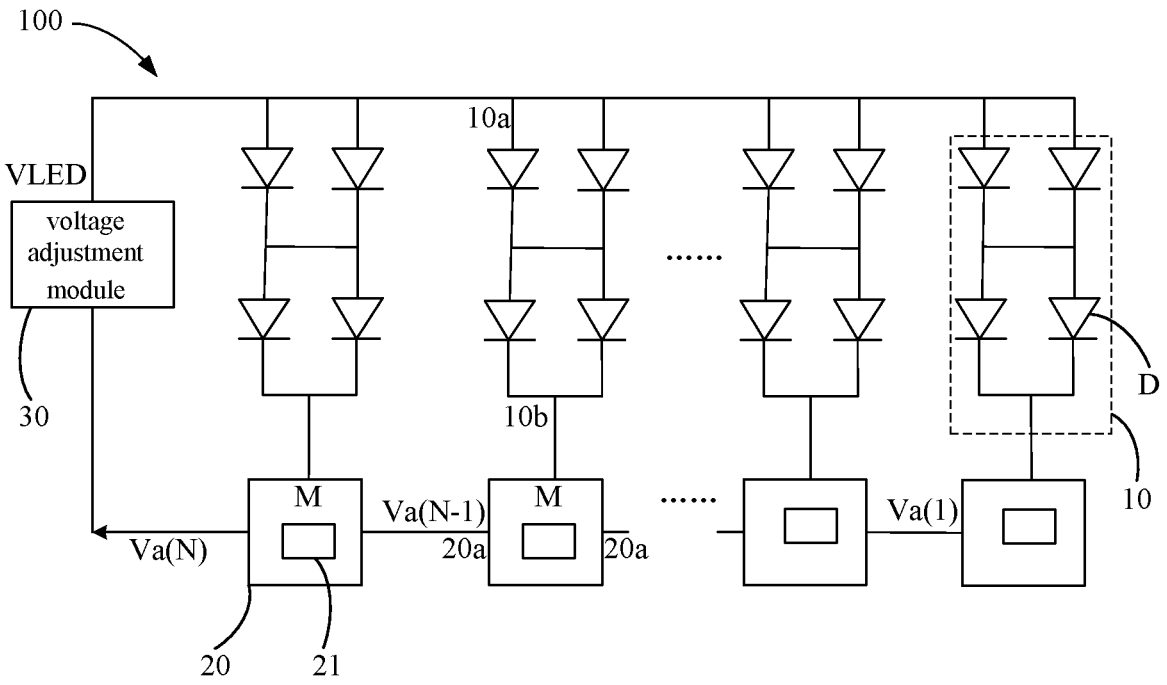
FIG. 1 is a first schematic structural diagram of a backlight module according to the present application.
Figure 2:
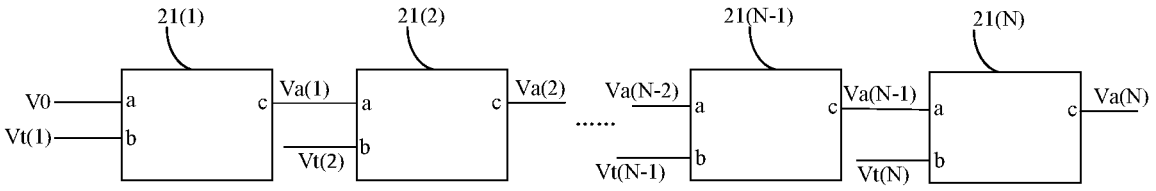
FIG. 2 is a schematic structural diagram of a plurality of cascaded voltage comparators according to the present application.

Referring to FIGS. 1 and 2, FIG. 1 is a first schematic structural diagram of a backlight module according to the present application. FIG. 2 is a schematic structural diagram of a plurality of cascaded voltage comparators 21 according to the present application. In the embodiment of the present application, the backlight module 100 includes a plurality of light-emitting units 10, a plurality of drive chips 20, a plurality of cascaded voltage comparators 21, and a voltage adjustment module 30.

Each of the plurality of light-emitting units 10 has a positive electrode 10*a* and a negative electrode 10*b*. At least a part of the positive electrodes 10*a* of the light-emitting units are connected with a same initial drive voltage VLED.

Each of the plurality of drive chips 20 includes a control terminal M. The control terminal M is connected to the negative electrode 10*b* of a corresponding light-emitting unit 10. Each drive chip 20 is disposed corresponding to at least one voltage comparator 21. Each voltage comparator 21 has a first input terminal a, a second input terminal b and an output terminal c. A second input terminal b of a voltage comparator 21(N) in the N-th stage is connected with a to-be-detected voltage Vt(N) in the N-th stage. The to-be-detected voltage Vt(N) in the N-th stage is a voltage of the control terminal M of the drive chip 20 corresponding to the voltage comparator 21(N) in the N-th stage. The output terminal c of the voltage comparator 21(N) in the N-th stage outputs an adjustment voltage Va in the N-th stage. The first input terminal a of the voltage comparator 21(1) in the first stage is connected with a preset voltage V0. The adjustment voltage Va (1) in the first stage is the one with a lower value of the preset voltage V0 and the to-be-detected voltage Vt (1) in the first stage. The first input terminal a of the voltage comparator 21(N) in the N-th stage is connected with the adjustment voltage Va(N−1) in the (N−1)-th stage. The adjustment voltage Va(N) in the N-th stage is the one with lower value of the to-be-detected voltage Vt(N) in the N-th stage and the adjustment voltage Va(N−1) in the (N−1)-th stage. N is an integer greater than 1.

The voltage adjustment module 30 is connected to the adjustment voltage Va(N) in the N-th stage. The voltage adjustment module 30 is configured to adjust the initial drive voltage VLED according to the adjustment voltage Va(N) in the N-th stage. The voltage comparator 21(N) in the N-th stage may be understood as the voltage comparator at last stage of the plurality of cascaded voltage comparators 21.

The plurality of voltage comparators 21 may be sequentially cascaded from right to left as shown in FIG. 1, or may be sequentially cascaded from left to right, which is not limited in the present application.

Each light-emitting unit 10 includes one or more light-emitting diodes D. The light-emitting diode D may be Micro LED or Mini LED. For example, in the embodiment of the present application, each light-emitting unit 10 includes four light-emitting diodes D. Wherein every two light-emitting diodes D are connected in series and then in parallel to others. The structure of the light-emitting unit 10 in the embodiment of the present application is not limited thereto, and details are not described herein.

It will be appreciated that the drive chip 20 may include one or more control terminals M. The control terminal M of the drive chip 20 is connected to the negative electrode 10*b* of the light-emitting unit 10 in a one-to-one correspondence. Therefore, the to-be-detected voltage Vt(N) in the N-th stage is a voltage of a control terminal M of the drive chip 20 corresponding to the voltage comparator 21(N) in the N-th stage. That is, the to-be-detected voltage Vt(N) in the N-th stage is the voltage of the negative electrode 10*b* of the corresponding light-emitting unit 10.

According to the cascade relationship of the plurality of voltage comparators 21, when the voltages of the plurality of control terminals M of the drive chips 20 are all higher than the preset voltage V0, the adjustment voltage output by the voltage comparator 21 in the N-th stage is the preset voltage V0. When the voltage of at least one control terminal M of the drive chips 20 is lower than the preset voltage V0, and the voltage of the control terminal M is the to-be-detected voltage Vt input to the corresponding voltage comparator 21, the adjustment voltage Va (N) in the N-th stage output by the voltage comparator 21 in the N-th stage is the to-be-detected voltage Vt. Thus, according to the embodiment of the present application, the relationship between the voltage of the control terminal M of the drive chip 20 and the preset voltage V0 can be determined and further it can determine whether the voltage of the control terminal M of the drive chip 20 is high or not.

In the embodiment of the present application, a plurality of cascaded voltage comparators 21 are provided in the backlight module 100. The first input terminal a of the first stage voltage comparator 21(1) in the first stage is connected with a preset voltage V0. A second terminal b of the voltage comparator 21(N) in the N-th stage is connected with the to-be-detected voltage Vt(N) in the N-th stage. Since the to-be-detected voltage Vt(N) in the N-th stage is the voltage of the control terminal M of the drive chip 20 corresponding to the voltage comparator 21(N) in the N-th stage, the plurality of cascaded voltage comparators 21 can detect the voltage of at least one control terminal M of each drive chip 20. That is, the plurality of cascaded voltage comparators 21 may output the adjustment voltage Va(N) in the N-th stage based on the preset voltage V0 and the plurality of the to-be-detected voltages, and then the voltage adjustment module 30 adjusts the initial drive voltage VLED based on the adjustment voltage Va(N) in the N-th stage. This prevents the voltage of the control terminal M of the drive chip 20 from being too high, thereby reducing the power consumption of the drive chip 20 and reducing the risk of overheating the drive chip 20.

In the embodiments of the present application, "a plurality of" refers to at least two.

The backlight module 100 in the embodiment of the present application has the function of local dimming. If the negative electrode 10*b* of the light-emitting unit 10 is directly grounded, the plurality of light-emitting units 10 will be all on once the positive electrode 10*a* is energized, and local dimming is not provided at this time.

In the embodiment of the present application, with a small number of the light-emitting units, the positive electrode 10*a* of all the light-emitting units may be connected with the same initial drive voltage VLED. This reduces the number of output ports outputting the initial drive voltage VLED and the corresponding connection lines, and reduces the complexity of the signal generation lines of the backlight module 100.

In other embodiments of the present application, with a larger size of the backlight module 100 and a larger number of light-emitting units, a plurality of light-emitting units may be divided into a plurality of regions in order to better realize the function of the local dimming. The positive electrodes 10*a* of the plurality of light-emitting units in each region are connected with an individual initial drive voltage VLED. That is, the backlight module 100 a plurality of initial drive voltages VLED that are controlled independently. The voltage values of the plurality of initial drive voltages VLED may be equal to or different from each other, and may be specifically set based on the luminance requirement of the backlight module 100. The voltage values of the plurality of initial drive voltages VLED may also be individually adjusted based on the scheme of the embodiment of the present application.

Figure 3:
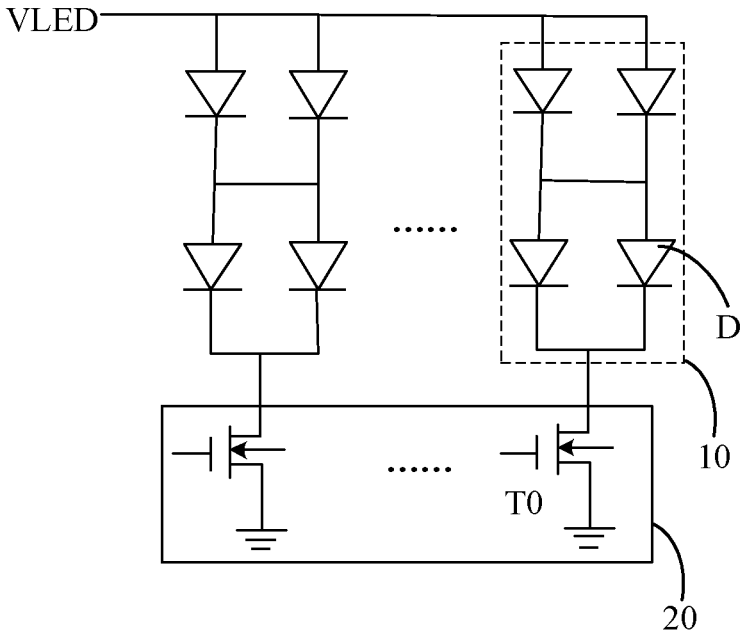
FIG. 3 is a schematic connection diagram of a light-emitting unit and a drive chip according to the present application.

Specifically, referring to FIG. 3, FIG. 3 is a schematic connection diagram of a light-emitting unit and a drive chip according to the present application. The negative electrode 10*b* of the light-emitting unit 10 is connected to the control terminal M of the drive chip 20, and is further connected to the ground terminal. A switching transistor T0 is provided in the drive chip 20. The switching transistor T0 controls a communication between the negative electrode 10*b* of the light-emitting unit 10 and the ground terminal. In this way, the function of the local dimming can be realized by the control terminal M of the drive chip 20.

In the embodiment of the present application, the voltage value of the initial drive voltage VLED is lower than or equal to the voltage difference between the positive electrode 10*a* and the negative electrode 10*b* when the light-emitting unit 10 emits light normally. When the adjustment voltage Va(N) in the N-th stage is lower than the preset voltage V0, the voltage adjustment module 30 increases the initial drive voltage VLED.

It should be understood that the voltage value of the preset voltage V0 is usually determined by the operation performance of the drive chip 20. For example, when the voltage of the control terminal M of the drive chip 20 is lower than 0.2 V, an abnormal operation occurs. Therefore, it is necessary to ensure that the voltage of the control terminal M of the drive chip 20 is not lower than 0.2 V. In the embodiment of the present application, the preset voltage V0 ranges from 0.2 V to 0.5 V. For example, the preset voltage V0 may be 0.2 V, 0.3 V, 0.4 V, 0.5 V, etc.

Further, as shown in FIG. 1, assuming that the voltage drop of the light-emitting unit 10 is 3V when the light-emitting unit 10 emits a light, and each light-emitting unit 10 includes four light-emitting diodes D. While each light-emitting diode D has a deviation during the manufacture, and the voltage drop may be actually between 2.8 V-3.3 V. Each light-emitting unit 10 requires a voltage about 6 V for the normal light emission. In the backlight module, in order to ensure that all the light-emitting diodes D can be lighted, the initial drive voltage VLED is usually set to be large, for example, set to 7.5 V. If the light-emitting voltage drop of the light-emitting diode D in a certain light-emitting unit 10 is exactly 2.8 V, the light-emitting unit 10 normally emits light by a voltage of 5.6 V. At this time, the excess voltage will fall on the control terminal M of the drive chip 20. The excess voltage is about 7.5 V-5.6 V=1.9 V. This may result in overheating and increased power consumption of the drive chip 20, thereby causing a risk of damage.

Therefore, the embodiment of the present application provides that the voltage value of the initial drive voltage VLED is lower than or equal to the voltage difference between the positive electrode 10*a* and the negative electrode 10*b* when the light-emitting unit 10 emits light normally. At this time, the voltage of the control terminal M is lower than the preset voltage V0. The adjustment voltage Va(N) in the N-th stage output by the voltage comparator 21 in the N-th stage is lower than the preset voltage V0. The voltage adjustment module 30 may increase the initial drive voltage VLED based on the adjustment voltage Va(N) in the N-th stage until the adjustment voltage Va (N) in the N-th stage is equal to the preset voltage V0.

The embodiment of the present application can prevent the voltage of the control terminal M of the drive chip 20 from being too high, thereby reducing the power consumption and temperature of the drive chip 20. At the same time, by the adjusting function of the voltage adjustment module 30, it ensures that the drive chip 20 normally operates and the light-emitting unit 10 normally emits a light.

In the embodiment of the present application, the initial drive voltage VLED may be set to be higher than the voltage difference between the positive electrode 10*a* and the negative electrode 10*b* when the light-emitting unit 10 normally emits a light. In this way, the preset voltage V0 can be set to be slightly higher than the voltage of the control terminal M when the drive chip 20 operates normally. At this time, the voltage of the control terminal M of the drive chip 20 is higher than the preset voltage V0, and the adjustment voltage Va(N) in the N-th stage output by the voltage comparator 21 in the N-th stage is equal to the preset voltage V0. As such, it is illustrated that the initial drive voltage VLED is large, and the voltage adjustment module 30 may reduce the initial drive voltage VLED based on the N-th stage adjustment voltage Va until the adjustment voltage Va in the N-th stage is lower than the preset voltage V0.

In the embodiment of the present application, each drive chip 20 may be provided with at least one voltage comparator 21. For example, each drive chip 20 may be provided with one voltage comparator 21, five voltage comparators 21, twenty voltage comparators 21, and the like.

When each drive chip 20 is provided with one voltage comparator 21, the to-be-detected voltage Vt(N) in the N-th stage may be the voltage of any one of the control terminals M of the drive chip 20 corresponding to the voltage comparator 21(N) in the N-th stage. That is, the plurality of cascaded voltage comparators 21 detect the voltage of any one of the control terminals M of the drive chip 20. Thus, the voltage of the control terminal M of the drive chip 20 is randomly detected to reflect the overall operation state of the drive chip 20.

In other embodiments, when each drive chip 20 is provided with one voltage comparator 21, the to-be-detected voltage Vt (N) in the N-th stage may be the lowest one among the voltages of the plurality of control terminals M of the drive chip 20 corresponding to the voltage comparator 21(N) in the N-th stage. That is, the drive chip 20 can detect the voltages of the plurality of control terminals M therein, and then output the lowest one among the voltages of the plurality of control terminals M to the corresponding voltage comparator 21. Therefore, the operating state of the drive chip 20 can be more accurately reflected, and after adjustment by the voltage adjustment module 30, it ensures that each light-emitting unit 10 can normally emit a light.

In other embodiments, each control terminal M is provided with one voltage comparator 21 to detect the voltage of each control terminal M, thereby improving the accuracy of the detection.

Referring to FIG. 1, in the embodiment of the present application, the voltage comparator 21 is integrated in the corresponding drive chip 20. Thus, the extent of integration of the drive chip 20 can be improved. At the same time, the wirings in the backlight module 100 are reduced, and the density of the wirings is also reduced, so that the signal is prevented from crosstalk or short circuit. Similarly, if the size of the drive chips 20 is limited, each drive chip 20 is provided with only one voltage comparator 21.

In addition, in the embodiment of the present application, each drive chip 20 includes a data transmission pin 20*a*. Adjacent drive chips 20 are connected via the data transmission pins 20*a*. The drive chip 20 provided with the voltage comparator 21(N) in the N-th stage is connected to the voltage adjustment module 30 via a data transmission pin 20*a*. Each drive chip 20 is configured to output or receive a corresponding adjustment voltage via the data transmission pin 20*a* based on a signal transmission protocol.

The data transmission pin 20*a* is an existing pin of the drive chip 20, and is configured to transmit a backlight control signal and the like. The transmission protocol is controlled by the internal code of the driver chip 20. For example, the transmission data bits of the data transmission pin 20*a* may be changed by the transmission protocol to transmit a corresponding adjustment voltage while transmitting a backlight control signal.

Since the voltage comparator 21 is integrated in the corresponding drive chip 20, the adjustment voltage Va(N) in the N-th stage is output to the voltage comparator 21(N) in the N-th stage via the existing data transmission pin 20*a* in the drive chip 20 of the voltage comparator 21(N−1) in the (N−1)-th stage. Thus, there is no need to additionally provide the pin of the drive chip 20, thereby reducing the size of the drive chip 20.

Figure 4:
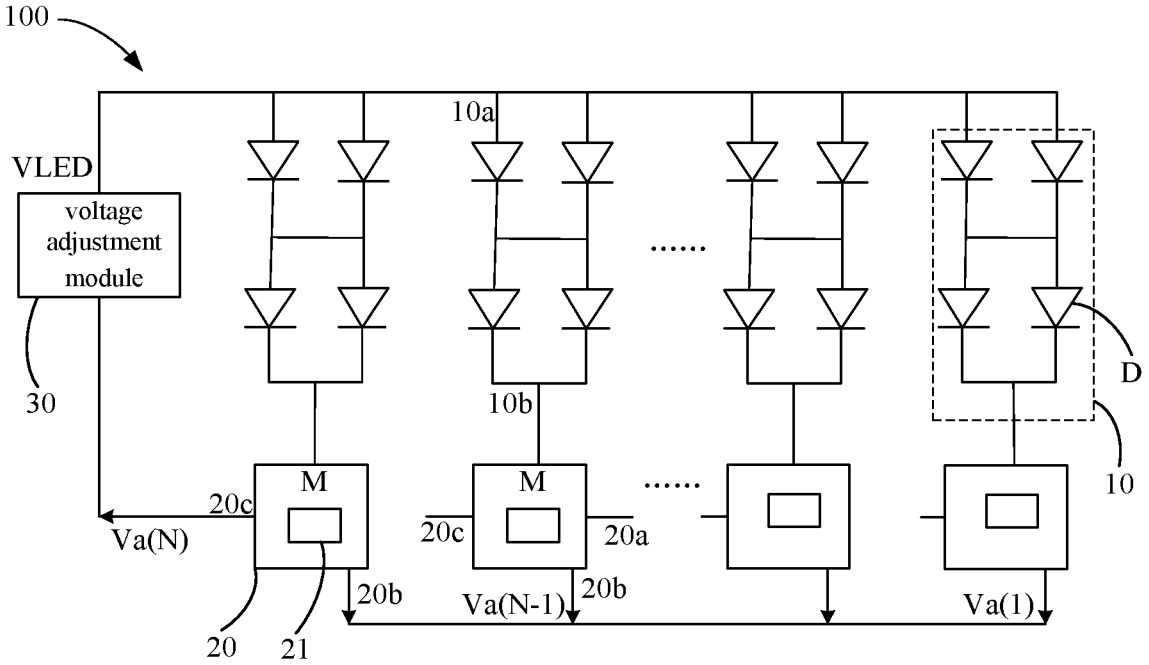
FIG. 4 is a second schematic structural diagram of a backlight module according to the present application.

In other embodiments of the present application, references are made to FIG. 4, wherein FIG. 4 is a second schematic structural diagram of the backlight module according to the present application. Differences from the backlight module 100 shown in FIG. 1 lie in that: in the embodiment of the present application, each drive chip 20 includes an adjustment voltage transmission pin 20*b*. The drive chip 20 in the voltage comparator 21(N) in the N-th stage further includes a feedback pin 20*c*. The drive chips 20 are connected to each other via the adjustment voltage transmission pin 20*b*. The drive chip 20 in voltage comparator 21(N) in the N-th stage is connected to the voltage adjustment module 30 through the feedback pin 20*c*.

In the embodiment of the present application, each drive chip 20 may include a feedback pin 20*c* during a mass production of the drive chip 20.

In the embodiment of the present application, each drive chip 20 includes a data transmission pin 20*a*. The adjustment voltage transmission pin 20*b* is an additional pin to use to transmit a corresponding adjustment voltage directly and separately.

Figure 5:
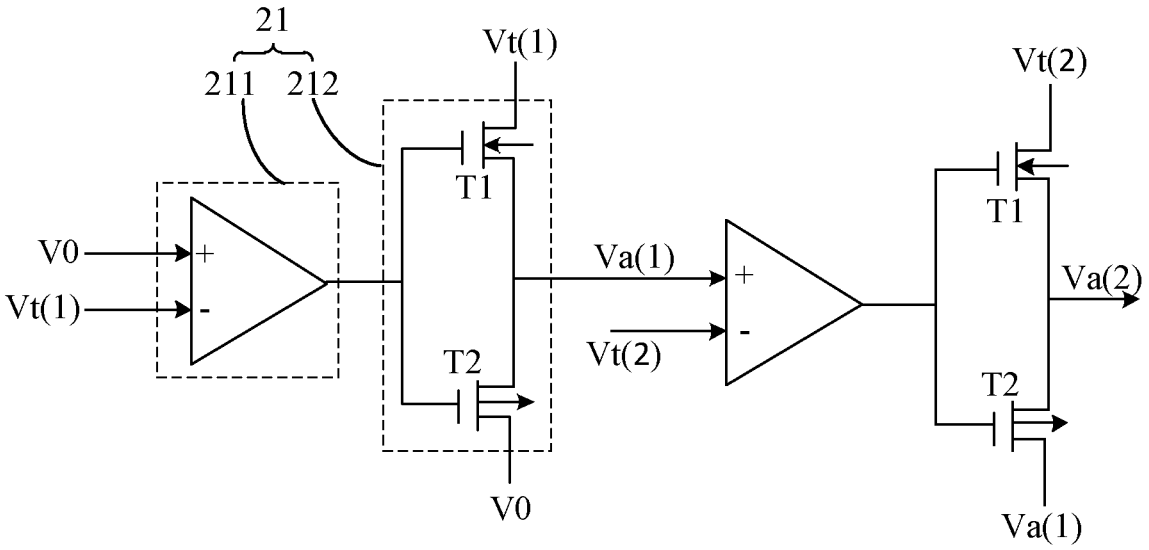
FIG. 5 is a first schematic circuit diagram of a plurality of cascaded voltage comparators according to the present application.

References are made to FIG. 5, wherein FIG. 5 is a first schematic circuit diagram of a plurality of cascaded voltage comparators according to the present application. In an embodiment of the present application, each voltage comparator 21 includes a comparator 211 and an inverter 212.

In a same voltage comparator 21, a first pole of the comparator 211 is connected to a first input terminal a. A second pole of the comparator 211 is connected to the second input terminal b. The inverter 212 includes a first transistor T1 and a second transistor T2. A gate of the first transistor T1 and a gate of the second transistor T2 are both connected to an output pole of the comparator 211. A source of the first transistor T1 is connected to the second input terminal b. A source of the second transistor T2 is connected to the first input terminal a. A drain of the first transistor T1 and a drain of the second transistor T2 both are connected to the output terminal c.

The transistors used in all embodiments of the present application may be thin film transistors or field effect transistors or other devices having the same characteristics. Since the source and drain of the transistors used herein are symmetrical, the source and drain of the transistors are interchangeable. In the embodiment of the present application, to distinguish the two poles of the transistor except the gate, one of the poles is referred to as a source and the other pole is referred to as a drain. In the figures, the switching transistor has a gate at the middle end, a source at the signal input end, and a drain at the output end. The transistor used in the embodiment of the present application may include a P-type transistor and/or an N-type transistor, wherein the P-type transistor is turned on when the gate is at the low level, and turned off when the gate is at the high level; the N-type transistor is turned on when the gate is at the high level, and turned off when the gate is at the low level.

In the embodiment of the present application, when the first pole of the comparator 211 is a positive input terminal, and the second pole of the comparator 211 is a negative input terminal, the first transistor T1 is an N-type transistor, and the second transistor T2 is a P-type transistor.

Specifically, in voltage comparator 21(1) in the first stage, the positive input terminal of the comparator 211 is connected with the present voltage V0. The negative input terminal of the comparator 211 is connected with the to-be-detected voltage Vt(1) in the first stage. The comparator 211 outputs a high level signal when the preset voltage V0 is higher than the to-be-detected voltage Vt(1) in the first stage. At this time, the first transistor T1 is turned on and the second transistor T2 is turned off. The adjustment voltage Va(1) in the first stage output by the inverter 212 is the to-be-detected voltage Vt(1) in the first stage. The comparator 211 outputs a low level signal when the preset voltage V0 is lower than the to-be-detected voltage Vt(1) in the first stage. At this time, the first transistor T1 is turned off, and the second transistor T2 is turned on. The adjustment voltage Va(1) in the first stage output by the inverter 212 is the preset voltage V0.

In voltage comparator 21(2) in the second stage, the positive input terminal of the comparator 211 is connected with the adjustment voltage Va(1) in the first stage. The negative input terminal of the comparator 211 is connected with the to-be-detected voltage Vt(2) in the second stage. The comparator 211 outputs a high level signal when the adjustment voltage Va(1) in the first stage is higher than the to-be-detected voltage Vt(2) in the second stage. At this time, the first transistor T1 is turned on, and the second transistor T2 is turned off. The inverter 212 outputs the to-be-detected voltage Vt(2) in the second stage. The comparator 211 outputs a low level signal when the adjustment voltage Va(1) in the first stage is lower than the to-be-detected voltage Vt(2) in the second stage. At this time, the first transistor T1 is turned off, and the second transistor T2 is turned on. The inverter 212 outputs the adjustment voltage Va(1) in the first stage.

It should be understood that the voltage comparator 21 (1) in the first stage and the voltage comparator 21 (2) in the second stage are taken as examples to describe the embodiments of the present application, but are not to be construed as limiting the present application.

Figure 6:
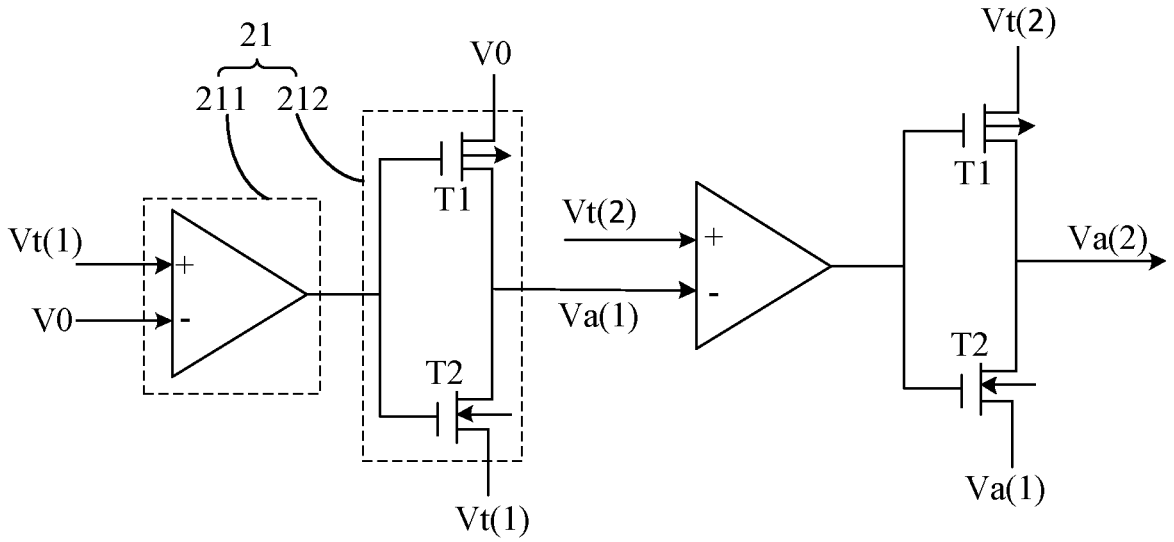
FIG. 6 is a second schematic circuit diagram of a plurality of cascaded voltage comparators according to the present application.

References are made to FIG. 6, wherein FIG. 6 is a second schematic circuit diagram of a plurality of cascaded voltage comparators according to the present application. Differences from the plurality of cascaded voltage comparators 21 shown in FIG. 4 lie in that: in the embodiment of the present application, when the first pole of the comparator 211 is a negative input terminal, and the second pole of the comparator 211 is a positive input terminal, the first transistor T1 is a P-type transistor, and the second transistor T2 is an N-type transistor.

Specifically, in voltage comparator 21(1) in the first stage, the positive input terminal of the comparator 211 is connected with the to-be-detected voltage Vt(1) in the first stage. The negative input terminal of the comparator 211 is connected with the present voltage V0. The comparator 211 outputs a low level signal when the preset voltage V0 is higher than the to-be-detected voltage Vt(1) in the first stage. At this time, the first transistor T1 is turned on and the second transistor T2 is turned off. The adjustment voltage Va(1) in the first stage output by the inverter 212 is the to-be-detected voltage Vt(1) in the first stage. The comparator 211 outputs a low level signal when the preset voltage V0 is lower than the to-be-detected voltage Vt(1) in the first stage. At this time, the first transistor T1 is turned off, and the second transistor T2 is turned on. The adjustment voltage Va(1) in the first stage output by the inverter 212 is the preset voltage V0.

In voltage comparator 21(2) in the second stage, the positive input terminal of the comparator 211 is connected with the to-be-detected voltage Vt(2) in the second stage. The negative input terminal of the comparator 211 is connected with the adjustment voltage Va(1) to be detected in the first stage. The comparator 211 outputs a high level signal when the adjustment voltage Va(1) in the first stage is higher than the to-be-detected voltage Vt(2) in the second stage. At this time, the first transistor T1 is turned on, and the second transistor T2 is turned off. The inverter 212 outputs the to-be-detected voltage Vt(2) in the second stage. The comparator 211 outputs a low level signal when the adjustment voltage Va(1) in the first stage is lower than the to-be-detected voltage Vt(2) in the second stage. At this time, the first transistor T1 is turned off, and the second transistor T2 is turned on. The inverter 212 outputs the adjustment voltage Va(1) in the first stage.

Figure 7:
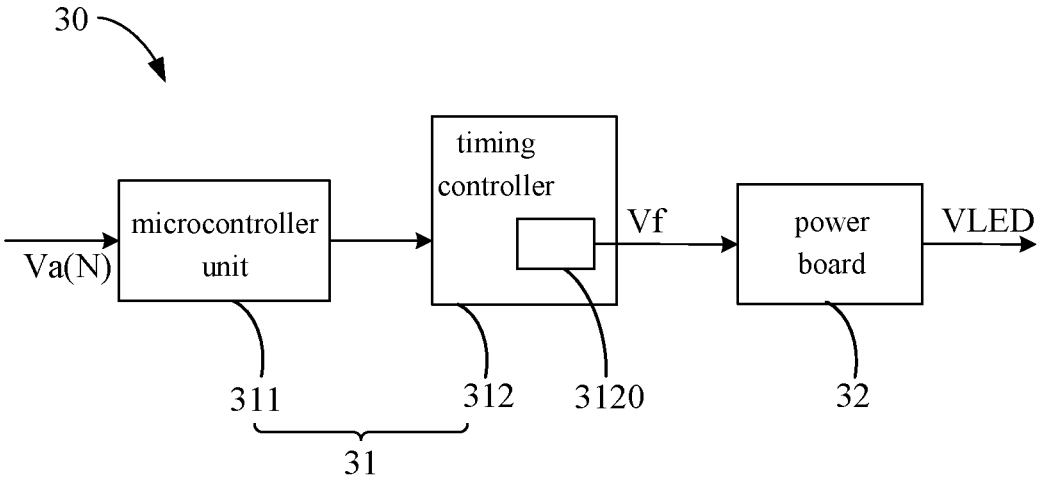
FIG. 7 is a schematic structural diagram of a voltage adjustment module according to the present application.

References are made to FIG. 1 and FIG. 7, wherein FIG. 7 is a schematic structural diagram of a voltage adjustment module according to the present application. In the embodiment of the present application, the voltage adjustment module 30 includes a control unit 31 and a power board 32.

The control unit 31 is connected to the output terminal c of the voltage comparator 21 in the N-th stage to connect with the adjustment voltage Va(N) in the N-th stage. The control unit 31 is configured to output a feedback voltage Vf to the power board 32 based on the adjustment voltage Va(N) in the N-th stage. The power board 32 is configured to adjust the initial drive voltage VLED under the control of the feedback voltage Vf.

Further, the control unit includes a microcontroller unit (MCU) 311 and a timing controller 312. The microcontroller unit 311 is connected to the output terminal c of the voltage comparator 21 in the N-th stage. The microcontroller unit 311 is configured to process the adjustment voltage Va(N) in the N-th stage. For example, the microcontroller unit 311 is configured to process with analog-to-digital conversion, noise reduction, and the like. The timing controller 312 is connected to the microcontroller unit 311. The timing controller 312 includes a power management integrated chip 3120. The timing controller 312 outputs a voltage compensation instruction to the power management integrated chip 3120 based on the processed adjustment voltage Va(N) in the N-th stage. The power management integrated chip 3120 outputs the feedback voltage Vf based on the voltage compensation instruction.

The microcontroller unit 311, also known as a single-chip microcomputer or a single-chip microcomputer, is a single chip that appropriately reduces the frequency and size of the central processing unit, and integrates peripheral interfaces such as memory, counter, analog-to-digital converter and memory, and even panel drive circuits.

The timing controller 312 may be configured to compare the adjustment voltage Va(N) in the N-th stage with the preset voltage V0 to determine whether the initial drive voltage VLED is requested to be adjusted. If the initial drive voltage VLED is requested to be adjusted, the voltage compensation instruction is output to the power management integrated chip 3120. The power management integrated chip 3120 outputs the feedback voltage Vf based on the voltage compensation instruction. The voltage compensation instruction may be an instruction that instructs the power management integrated chip 3120 to output the feedback voltage Vf.

In some embodiments of the present application, the control unit 31 may merely include the timing controller 312. The timing controller 312 directly receives the adjustment voltage Va(N) in the N-th stage. The Details of receiving may be specifically designed based on the logic function of the timing controller 312, and the present application is not limited thereto.

Figure 8:
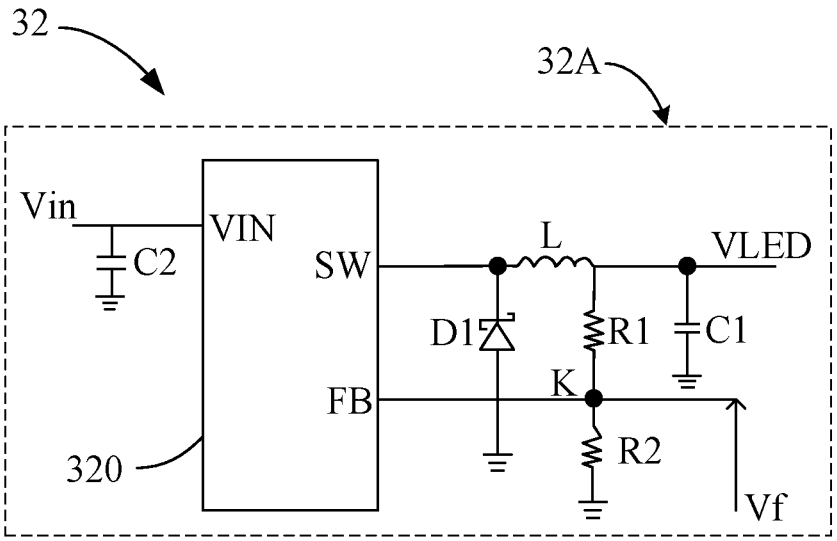
FIG. 8 is a schematic structural diagram of a power board according to the present application.

References are made to FIG. 8, wherein FIG. 8 is a schematic structural diagram of a power board according to the present application. In the embodiment of the present application, the power board 32 includes at least one voltage adjustment circuit 32A. Each voltage adjustment circuit 32A includes a control chip 320, an inductor L, a first resistor R1, and a second resistor R2.

Specifically, the control chip 320 has an input pin VIN, a switch pin SW, and a feedback pin FB. The input pin VIN is connected with an initial voltage Vin. An end of the inductor L is connected to the switch pin SW. The other end of the inductor L and an end of the first resistor R1 are connected to the output terminal of the initial drive voltage. The other end of the first resistor R1 and an end of the second resistor R2 are connected to the feedback node K. The feedback node K is connected to the feedback pin FB and is connected with the feedback voltage Vf. The other end of the second resistor R2 is grounded.

The control chip 320 is a voltage conversion chip, and is usually a step-down chip. The initial voltage Vin is converted into a voltage by the internal logic circuit of the control chip 320, and output by the switch pin SW. The switch pin SW is filtered by the external inductor L, and the feedback loop (the first resistor R1 and the second resistor R2) detects the output voltage, thereby achieving the function of voltage stabilization.

The potential of the feedback pin FB is fixed and determined by the control chip 320. For example, the potential of the feedback pin FB is 0.8 V, as such, the current IR2 flowing through the second resistor R2 is constant, wherein the current IR2 satisfies the formula: IR2=0.8/R2.

In the embodiment of the present application, when a request of increasing the initial drive voltage VLED is identified by the timing controller 312, the voltage compensation instruction is sent to the power management integrated chip 3120. The current flowing through the first resistor R1 is increased by the power management integrated chip 3120 outputting the feedback voltage Vf to the feedback pin FB. At this time, the current IR1 flowing through the first resistor R1 increases as the feedback voltage Vf increases, wherein the current IR1 satisfies the formula: IR1=IR2+Vf/R2. The initial drive voltage VLED satisfies the formula: VLED=0.8+(IR2+Vf/R2)*R1. The values of R1 and R2 are constant. Thus, the initial drive voltage VLED increases accordingly as the feedback voltage increases.

Further, the voltage adjustment circuit 32A further includes a first capacitor C1 and a second capacitor C2. An end of the first capacitor C1 is connected to the input pin VIN, and an end of the second capacitor C2 is connected to the output terminal of the initial drive voltage. The other end of the first capacitor C1 and the other end of the second capacitor C2 are both grounded. The first capacitor C1 and the second capacitor C2 serve for voltage stabilization.

Further, in some embodiments, the power board 32 provides a Schottky diode D1 connected between the external switch pin SW and the ground terminal, which may be set based on the internal logic circuit of the control chip 320.

In the embodiment of the present application, the power board 32 may further include other circuit structures as long as the adjustment of the initial drive voltage VLED can be realized based on the feedback voltage Vf.

In addition, it should be understood from the above-described embodiment that, there may be a plurality of independent initial drive voltages VLED in the backlight module 100 to drive the plurality of light-emitting units to emit a light independently. As such, the power board 32 may include a plurality of voltage adjustment circuits 32A to output a plurality of independent initial drive voltages VLED. The number of power boards 32 may be in one-to-one correspondence with the number of initial drive voltages VLED.

Figure 9:
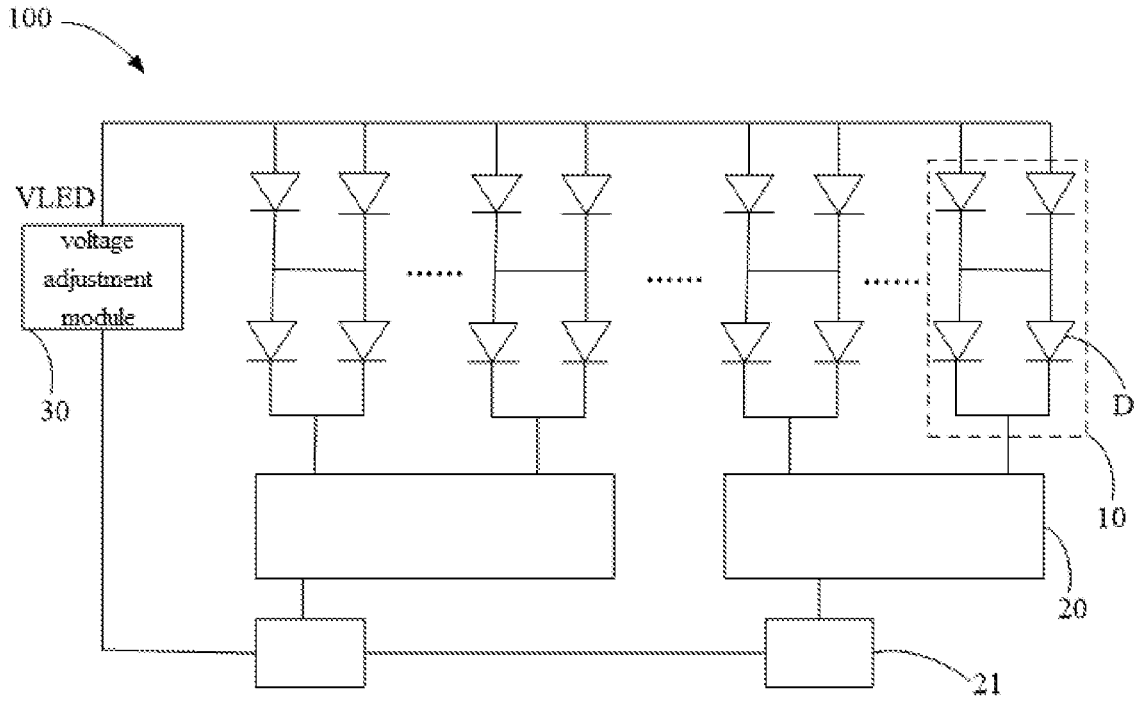
FIG. 9 is a third schematic structural diagram of a backlight module according to the present application.

References are made to FIG. 9, wherein FIG. 9 is a second schematic structural diagram of a backlight module according to the present application. Differences from the backlight module 100 shown in FIG. 1 lie in that: in the embodiment of the present application, a plurality of cascaded voltage comparators 21 are provided outside the drive chip 20.

Thus, the embodiment of the present application can further reduce the power consumption of the drive chip 20, and prevent the drive chip 20 from operating poorly due to the high temperature.

Accordingly, the present application further provides a display device including a display panel and a backlight module. The backlight module is the backlight module 100 of any of the above embodiments, and details are not described herein again. Further, the display device may be a smartphone, a tablet computer, an electronic book reader, a smart watch, a video camera, a game machine, and the like, and the present application is not limited thereto.

Figure 10:
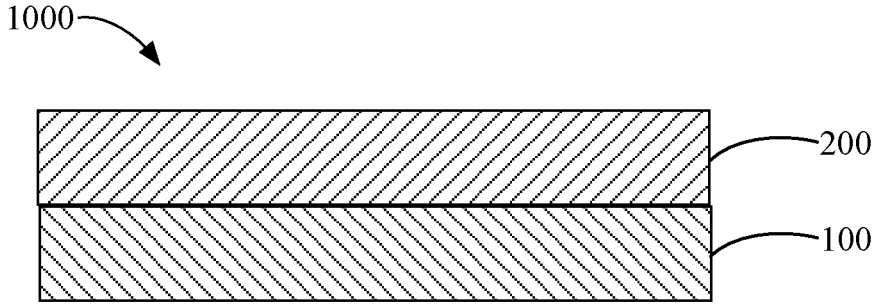
FIG. 10 is a schematic structural diagram of a display device according to the present application.

Specifically, references are made to FIG. 10, wherein FIG. 10 is a schematic structural diagram of a display device according to the present application.

The display device 1000 includes a backlight module 100 and a display panel 200, wherein the backlight module 100 and the display panel 200 are disposed opposite to each other. The backlight module 100 is configured to provide a light source for the display panel 200 to display normally.

In the display device 1000 provided by the present application, the backlight module includes a plurality of light-emitting units, a plurality of drive chips, a plurality of cascaded voltage comparators, and a voltage adjustment module. Control terminals of the plurality of drive chips are in one-to-one corresponding connections with negative electrodes of the plurality of light-emitting units connected with a same initial drive voltage. A first input terminal of the voltage comparator in the first stage is connected with a preset voltage, a second input terminal of the voltage comparator in the N-th stage is connected with a to-be-detected voltage in the N-th stage, and N is an integer greater than or equal to 1. Since the to-be-detected voltage in the N-th stage is a voltage at a control terminal of the drive chip corresponding to the voltage comparator in the N-th stage, a plurality of cascaded voltage comparators can detect a voltage of at least one control terminal of each drive chip. That is, the plurality of cascaded voltage comparators can output the adjustment voltage in the N-th stage based on the preset voltage and the plurality of to-be-detected voltages, and then the voltage adjustment module is configured to adjust the initial drive voltage based on the adjustment voltage in the N-th stage. This prevents the voltage at the control end of the drive chip from being too high, thereby reducing the power consumption and temperature of the drive chip and improving the quality of the display device 1000.

The backlight module and display device provided by the present application are described in detail above. The principles and implementation of the present application are described herein by examples. The description of the above embodiments is only used to help understand the method and core idea of the present application. At the same time, according to the idea of the present application, there will be some changes in the embodiments and application scope to those skilled in the art. In conclusion, the contents of the present specification shall not be construed as limiting the present application.

What is claimed is:

1. A backlight module, comprising:

a plurality of light-emitting units, wherein each of the plurality of light-emitting units has a positive electrode and a negative electrode, and at least a part of the positive electrodes of the plurality of light-emitting units are connected with a same initial drive voltage;

a plurality of drive chips, wherein each of the plurality of drive chips has a control terminal connected to the negative electrode of a corresponding light-emitting unit, and the light-emitting units connected to the control terminal of a same drive chip are connected with the same initial drive voltage;

a plurality of cascaded voltage comparators, wherein each of the plurality of drive chips corresponds to at least one of the voltage comparators, each of the plurality of voltage comparators has a first input terminal, a second input terminal and an output terminal; wherein a second input terminal of a voltage comparator in a N-th stage is connected with a to-be-detected voltage in the N-th stage, the to-be-detected voltage in the N-th stage is a voltage of the control terminal of the drive chip corresponding to the voltage comparator in the N-th stage, and an output terminal of the voltage comparator in the N-th stage outputs an adjustment voltage in the N-th stage; wherein a first input terminal of a voltage comparator in a first stage is connected with a preset voltage, and an adjustment voltage in the first stage is a lower one of the preset voltage and a to-be-detected voltage in the first stage; wherein a first input terminal of the voltage comparator in the N-th stage is connected with an adjustment voltage in a (N−1)-th stage, the adjustment voltage in the N-th stage is a lower one of the to-be-detected voltage in the N-th stage and the adjustment voltage in the (N−1)-th stage, and N is an integer greater than 1; and a voltage adjustment module, wherein the voltage adjustment module is connected with the adjustment voltage in the N-th stage, and the voltage adjustment module is configured to adjust the initial drive voltage based on the adjustment voltage in the N-th stage.

2. The backlight module of claim 1, wherein the voltage comparator is disposed in a one-to-one correspondence with the drive chip, the drive chip comprises a plurality of control terminals, each of the plurality of control terminals is connected to a negative electrode of a corresponding light-emitting unit, and the to-be-detected voltage in the N-th stage is a lowest one among the plurality of control terminals of the drive chip corresponding to the voltage comparator in the N-th stage.

3. The backlight module of claim 1, wherein the voltage comparator comprises a comparator and an inverter;

in a same voltage comparator, a first pole of the comparator is connected to the first input terminal, and a second pole of the comparator is connected to the second input terminal; the inverter comprises a first transistor and a second transistor, a gate of the first transistor and a gate of the second transistor are both connected to an output pole of the comparator, a source of the first transistor is connected to the second input terminal, a source of the second transistor is connected to the first input terminal, and a drain of the first transistor and a drain of the second transistor are both connected to the output terminal;

when the first pole of the comparator is a positive input terminal, and the second pole of the comparator is a negative input terminal, the first transistor is an N-type transistor, and the second transistor is a P-type transistor;

when the first pole of the comparator is a negative input terminal, and the second pole of the comparator is a positive input terminal, the first transistor is a P-type transistor, and the second transistor is an N-type transistor.

4. The backlight module of claim 1, wherein the initial drive voltage is lower than or equal to a voltage difference between the positive electrode and the negative electrode when the light-emitting unit emits a light normally;

when the adjustment voltage in the N-th stage is lower than the preset voltage, the voltage adjustment module is configured to increase the initial drive voltage.

5. The backlight module of claim 1, wherein the voltage adjustment module comprises a control unit and a power board;

the control unit is connected to an output terminal of the voltage comparator in the N-th stage to output a feedback voltage to the power board based on the adjustment voltage in the N-th stage; the power board is configured to adjust the initial drive voltage under a control of the feedback voltage.

6. The backlight module of claim 5, wherein the control unit comprises a microcontroller unit and a timing controller;

the microcontroller unit is connected to an output terminal of the voltage comparator in the N-th stage and configured to process the adjustment voltage in the N-th stage; the timing controller is connected to the microcontroller unit and comprises a power management integrated chip, the timing controller outputs a voltage compensation instruction to the power management integrated chip based on a processed adjustment voltage in the N-th stage, and the power management integrated chip outputs the feedback voltage based on the voltage compensation instruction.

7. The backlight module of claim 5, wherein the power board comprises at least one voltage adjustment circuit, and each of voltage adjustment circuits comprises a control chip, an inductor, a first resistor, and a second resistor;

the control chip has an input pin, a switch pin and a feedback pin; the input pin is connected with an initial voltage, an end of the inductor is connected to the switch pin, another end of the inductor and an end of the first resistor are connected to an output terminal of the initial drive voltage, another end of the first resistor and an end of the second resistor are connected to a feedback node, the feedback node is electrically connected to the feedback pin and is connected with the feedback voltage, and another end of the second resistor is grounded.

8. The backlight module of claim 1, wherein the light-emitting unit comprises one or more light-emitting diodes.

9. The backlight module of claim 1, wherein the voltage comparator is integrated in a corresponding drive chip.

10. The backlight module of claim 9, wherein the drive chip comprises a data transmission pin, adjacent drive chips are connected via the data transmission pin, and the drive chip provided with the voltage comparator in the N-th stage is connected to the voltage adjustment module via the data transmission pin;

wherein the drive chip is configured to output or receive a corresponding adjustment voltage via the data transmission pin based on a signal transmission protocol.

11. The backlight module of claim 9, wherein the drive chip comprises an adjustment voltage transmission pin, and the drive chips are connected to each other via the adjustment voltage transmission pin; the drive chip provided with the voltage comparator in the N-th stage further comprises a feedback pin, and is connected to the voltage adjustment module via the feedback pin.

12. A display device, comprising a display panel and a backlight module, wherein the backlight module comprises:

a plurality of light-emitting units, wherein each of the plurality of light-emitting units has a positive electrode and a negative electrode, and at least a part of the positive electrodes of the plurality of light-emitting units are connected with a same initial drive voltage;

a plurality of drive chips, wherein each of the plurality of drive chips has a control terminal connected to the negative electrode of a corresponding light-emitting unit, and the light-emitting units connected to the control terminal of a same drive chip are connected with the same initial drive voltage;

a plurality of cascaded voltage comparators, wherein each of the plurality of drive chips corresponds to at least one of the voltage comparators, each of the plurality of voltage comparators has a first input terminal, a second input terminal and an output terminal; wherein a second input terminal of a voltage comparator in a N-th stage is connected with a to-be-detected voltage in the N-th stage, the to-be-detected voltage in the N-th stage is a voltage of the control terminal of the drive chip corresponding to the voltage comparator in the N-th stage, and an output terminal of the voltage comparator in the N-th stage outputs an adjustment voltage in the N-th stage; wherein a first input terminal of a voltage comparator in a first stage is connected with a preset voltage, and an adjustment voltage in the first stage is a lower one of the preset voltage and a to-be-detected voltage in the first stage; wherein a first input terminal of the voltage comparator in the N-th stage is connected with an adjustment voltage in a (N−1)-th stage, the adjustment voltage in the N-th stage is a lower one of the to-be-detected voltage in the N-th stage and the adjustment voltage in the (N−1)-th stage, and N is an integer greater than 1; and a voltage adjustment module, wherein the voltage adjustment module is connected with the adjustment voltage in the N-th stage, and the voltage adjustment module is configured to adjust the initial drive voltage based on the adjustment voltage in the N-th stage.

13. The display device of claim 12, wherein the voltage comparator is disposed in a one-to-one correspondence with the drive chip, the drive chip comprises a plurality of control terminals, each of the plurality of control terminals is connected to a negative electrode of a corresponding light-emitting unit, and the to-be-detected voltage in the N-th stage is a lowest one among the plurality of control terminals of the drive chip corresponding to the voltage comparator in the N-th stage.

14. The display device of claim 12, wherein the initial drive voltage is lower than or equal to a voltage difference between the positive electrode and the negative electrode when the light-emitting unit emits a light normally;

when the adjustment voltage in the N-th stage is lower than the preset voltage, the voltage adjustment module is configured to increase the initial drive voltage.

15. The display device of claim 12, wherein the voltage adjustment module comprises a control unit and a power board;

the control unit is connected to an output terminal of the voltage comparator in the N-th stage to output a feedback voltage to the power board based on the adjustment voltage in the N-th stage;

the power board is configured to adjust the initial drive voltage under a control of the feedback voltage.

16. The display device of claim 15, wherein the power board comprises at least one voltage adjustment circuit, and each of voltage adjustment circuits comprises a control chip, an inductor, a first resistor, and a second resistor;

the control chip has an input pin, a switch pin and a feedback pin; the input pin is connected with an initial voltage, an end of the inductor is connected to the switch pin, another end of the inductor and an end of the first resistor are connected to an output terminal of the initial drive voltage, another end of the first resistor and an end of the second resistor are connected to a feedback node, the feedback node is electrically connected to the feedback pin and is connected with the feedback voltage, and another end of the second resistor is grounded.

17. The display device of claim 12, wherein the light-emitting unit comprises one or more light-emitting diodes.

18. The display device of claim 12, wherein the voltage comparator is integrated in a corresponding drive chip.

19. The display device of claim 18, wherein the drive chip comprises a data transmission pin, adjacent drive chips are connected via the data transmission pin, and the drive chip provided with the voltage comparator in the N-th stage is connected to the voltage adjustment module via the data transmission pin;

wherein the drive chip is configured to output or receive a corresponding adjustment voltage via the data transmission pin based on a signal transmission protocol.

20. The display device of claim 18, wherein the drive chip comprises an adjustment voltage transmission pin, and the drive chips are connected to each other via the adjustment voltage transmission pin; the drive chip provided with the voltage comparator in the N-th stage further comprises a feedback pin, and is connected to the voltage adjustment module via the feedback pin.

* * * * *